US008882534B2

(12) United States Patent
Pizzi

(10) Patent No.: US 8,882,534 B2
(45) Date of Patent: Nov. 11, 2014

(54) CONDUCTIVE GRIPPING ELEMENT FOR RETAINING AND CONDUCTIVELY CONNECTING ELECTRIC WIRES

(71) Applicant: Morsettitalia S.p.A., Milan (IT)

(72) Inventor: Giordano Pizzi, Milan (IT)

(73) Assignee: Morsettitalia S.p.A., Milan (IT)

( * ) Notice: Subject to any disclaimer, the term of this patent is extended or adjusted under 35 U.S.C. 154(b) by 45 days.

(21) Appl. No.: 13/766,962

(22) Filed: Feb. 14, 2013

(65) Prior Publication Data

US 2013/0210268 A1 Aug. 15, 2013

(30) Foreign Application Priority Data

Feb. 15, 2012 (IT) ..... MI2012A0216

(51) Int. Cl.
*H01R 13/585* (2006.01)
*H01R 4/38* (2006.01)
*H01R 4/36* (2006.01)

(52) U.S. Cl.
CPC ..... *H01R 13/585* (2013.01); *H01R 4/38* (2013.01); *H01R 4/366* (2013.01)
USPC ..... 439/460

(58) Field of Classification Search
USPC ..... 439/811, 812, 460, 723, 717, 793
See application file for complete search history.

(56) References Cited

U.S. PATENT DOCUMENTS

| | | | | |
|---|---|---|---|---|
| 2,032,394 | A * | 3/1936 | Becker et al. | 439/793 |
| 3,344,394 | A * | 9/1967 | Kingsbury et al. | 439/814 |
| 3,539,977 | A * | 11/1970 | Woertz | 439/811 |
| 4,929,198 | A * | 5/1990 | Strate et al. | 439/709 |
| 5,203,716 | A * | 4/1993 | Martucci et al. | 439/411 |
| 5,674,079 | A * | 10/1997 | Auclair | 439/92 |
| 5,739,467 | A * | 4/1998 | Fabrizi | 174/60 |
| 5,934,818 | A * | 8/1999 | Schmitt et al. | 403/399 |
| 6,322,378 | B1 * | 11/2001 | Auclair | 439/99 |
| 6,475,038 | B1 * | 11/2002 | Franck | 439/811 |
| 6,533,605 | B1 * | 3/2003 | Reuter | 439/431 |
| 7,473,146 | B2 * | 1/2009 | Fuzetti et al. | 439/798 |
| 7,575,486 | B2 * | 8/2009 | Weber et al. | 439/811 |
| 7,632,160 | B2 * | 12/2009 | Corry et al. | 439/814 |
| 7,938,693 | B2 * | 5/2011 | Skowranek | 439/811 |
| 2002/0081914 | A1 | 6/2002 | Takaya et al. | |
| 2007/0059992 | A1 * | 3/2007 | Kim | 439/810 |

FOREIGN PATENT DOCUMENTS

| | | | |
|---|---|---|---|
| DE | 10023967 | A1 | 11/2001 |
| EP | 2034599 | A2 | 3/2009 |
| JP | 2007103270 | A | 4/2007 |

* cited by examiner

*Primary Examiner* — Alexander Gilman
(74) *Attorney, Agent, or Firm* — Mintz Levin Cohn Ferris Glovsky and Popeo, P.C.

(57) ABSTRACT

Conductive gripping element for retaining and conductively connecting electric wires (1,1*a*), comprising a body in the form of an overturned "U" with legs (10) extending in the vertical direction (Z-Z) and head (20) connecting in the transverse direction the top ends of the said legs (10), the head (20) of the "U" being cross-shaped with longitudinal arms (23) and transverse arms (22) and having a hole (21) with a female thread (21*a*), suitable for engagement with an actuating screw (2,2*a*), and with a deep-drawn annular part (21*b*) partially comprised in the transverse direction (Y-Y) within the thickness of the legs (10) of the "U" opposite a respective eyelet (11) formed in the end of the leg (10) adjacent to the head (20) itself.

13 Claims, 3 Drawing Sheets

Figure 1:
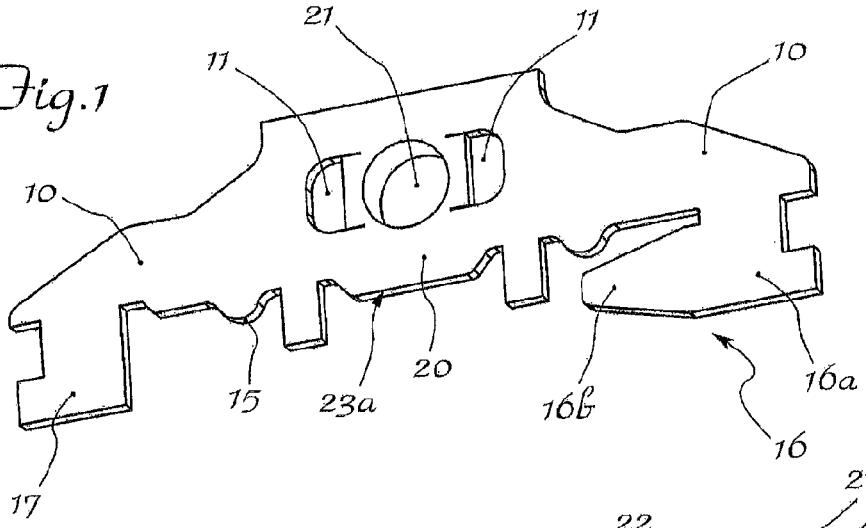

CONDUCTIVE GRIPPING ELEMENT FOR RETAINING AND CONDUCTIVELY CONNECTING ELECTRIC WIRES

RELATED APPLICATIONS

This application claims priority to Italian Patent Application No. MI2012A000216, filed on Feb. 15, 2012, the content of which is hereby incorporated by reference in its entirety.

DESCRIPTION

The present invention relates to a conductive gripping element for retaining electric wires and an electrical connection device provided with such a retaining element.

It is known, in the technical sector relating to electrical connection devices such as terminal strips, connection boxes and the like, to use terminal blocks designed to be mounted on corresponding supports and to provide frontal access to the means—normally of the screw type—for retaining the conductive connection wires which form the electric circuit.

It is also known that said means for retaining the end of the electric wire are normally designed with so-called sliders, movable in a direction perpendicular to the direction in which the wire is inserted, upon tightening a screw which causes retraction of the slider so as to grip the wire between the said slider and a counter plate extending parallel to the wire and designed to ensure the electrical continuity of the circuit inside the device.

As an alternative to said screw-operated sliders also known are wire gripping elements formed by a spring plate which is compressively deformed so as to allow opening of a slit and insertion of the wire inside its seat; once insertion has been completed the plate is released so as to return resiliently into the rest condition, causing gripping of the wire against the counter plate and ensuring the corresponding electrical connection.

Although fulfilling their function, these known gripping means nevertheless have drawbacks which, in the case of a screw-operated slider, essentially are the result of the complexity of design of the slider, the amount of material required to obtain an effective mechanical strength and the system for preventing unscrewing of the screw itself which tends to come loose with time, not guaranteeing the necessary gripping of the wire.

In the case of the spring, however, the drawback is associated with the resilient force which must be imparted to the plate in order to ensure suitable gripping of the wire, the cross-section of which increases with the increase in the electric loads, resulting in the need to increase also the size of the spring and therefore the corresponding dimensions, as well as its resilient force, with the result that the wire insertion operation becomes difficult.

Examples of the prior art according to the preamble of claim 1 are illustrated in EP 2,034,559 which describes a terminal block for conductively connecting together two conductive wires which are inserted in the transverse direction with respect to the legs of the U which have an L-shaped form with opposite free ends.

The surface for transversely connecting together the two legs of the U is not in the form of a cross since it does not have solid longitudinal and transverse arms which are instead replaced by recesses; the seat of the screw is therefore contained between the vertical legs of the U, but not in the thickness thereof, this latter constructional form being impossible since there is no material which is instead replaced by a recess.

In the example illustrated in the prior art it can also be noted that the screw is displaced axially owing to the screwing rotation, acting directly on the cable so as to grip it.

The technical problem which is posed, therefore, it is to provide a conductive gripping element for retaining electric wires, in particular for use inside connection devices such as terminal strips, connection boxes, wired-circuit switchboards and the like, which has small overall dimensions and a low weight, but at the same time is able to withstand a high electrical load and which combines the easy tightening action performed by means of screw with the advantages of irreversible gripping by means of a spring plate.

In connection with this problem it is also required that this terminal block should be easy and inexpensive to produce, be able to be used equally well with different types of electrical connection devices and be able to be easily operated by any user using normal standard tools. These results are achieved according to the present invention by a gripping element for retaining and conductively connecting electric wires according to the characteristic features of Claim 1 and by an electrical connection device provided with such a retaining element according to the characteristic features of Claim 10.

Figure 2:
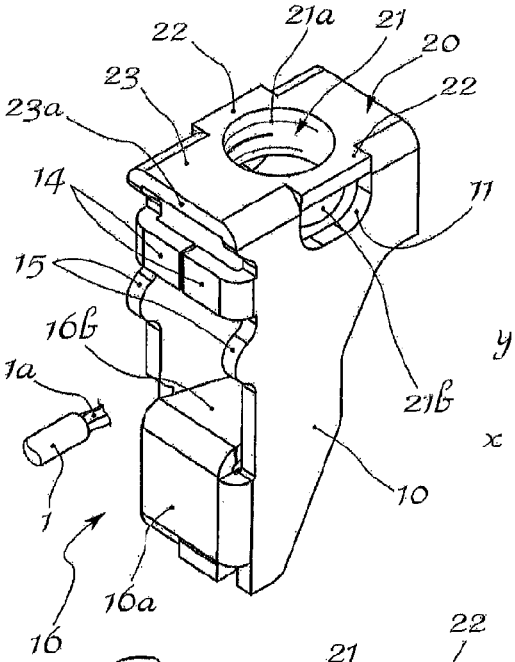
Figure 3:
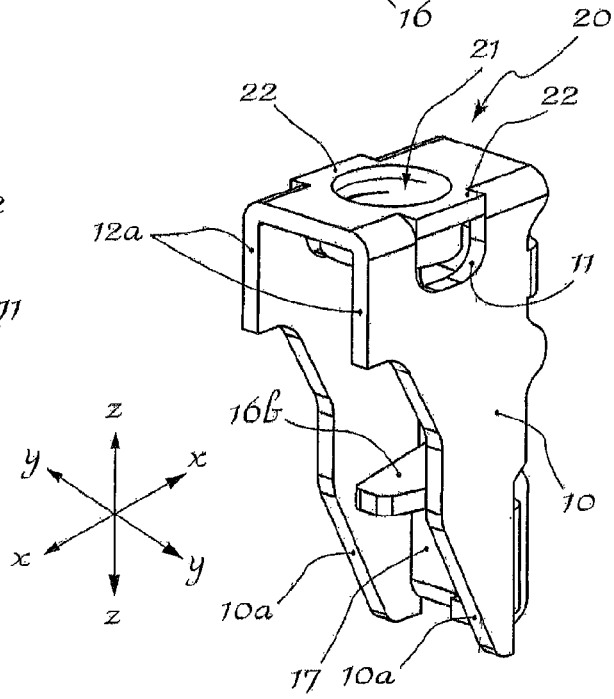
Figure 4:
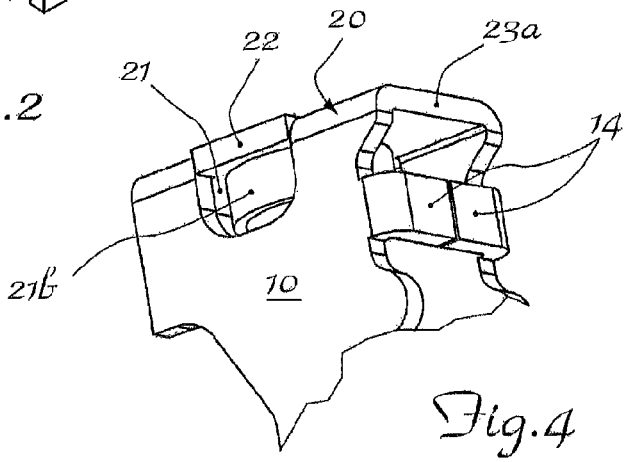
Figure 5:
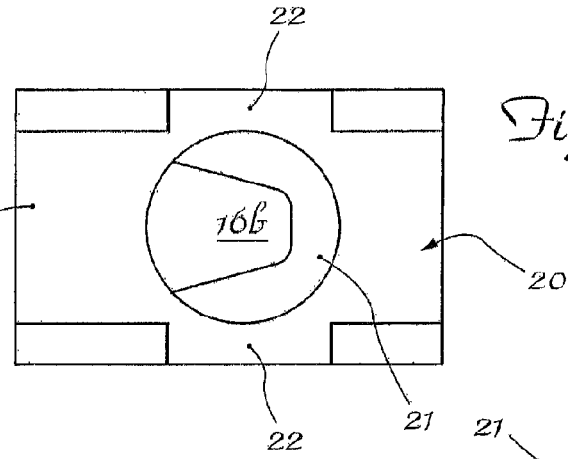
Figure 6:
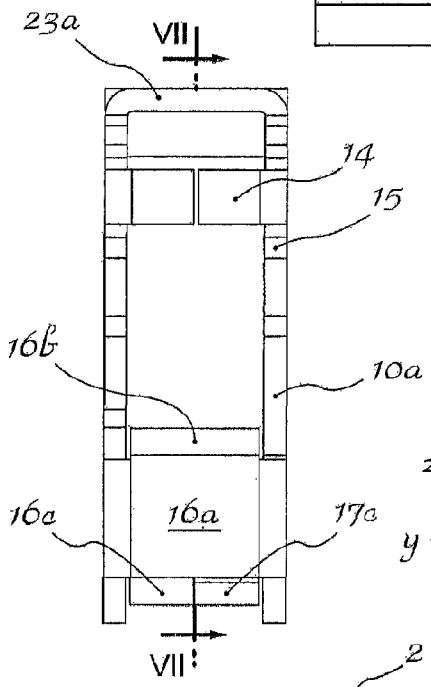
Figure 7:
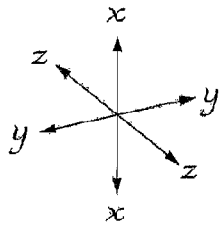
Figure 7:
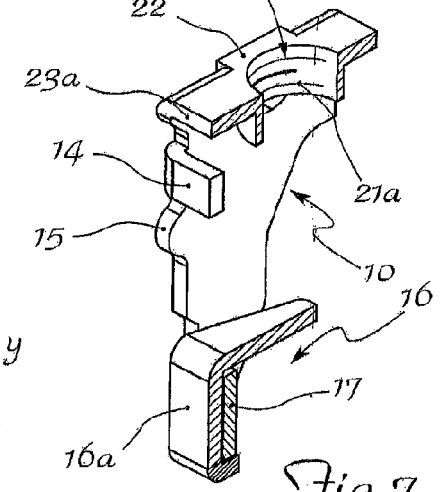
Figure 7A:
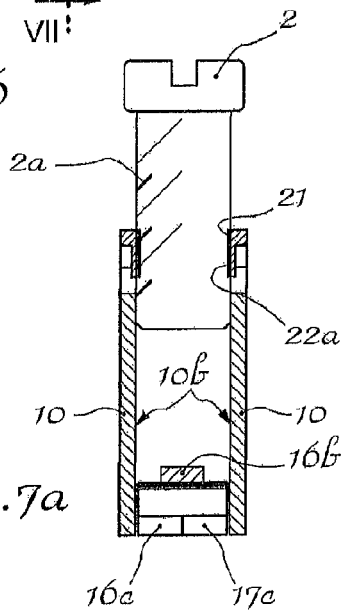
Figure 8:
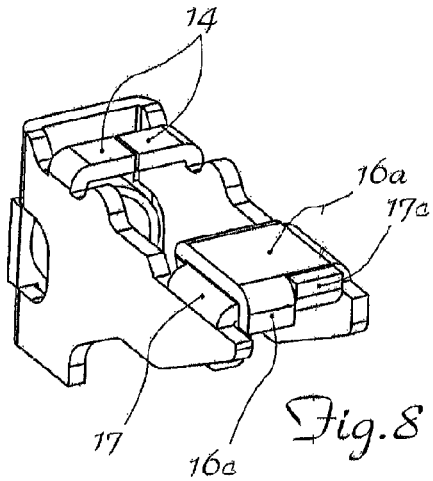
Figure 9A:
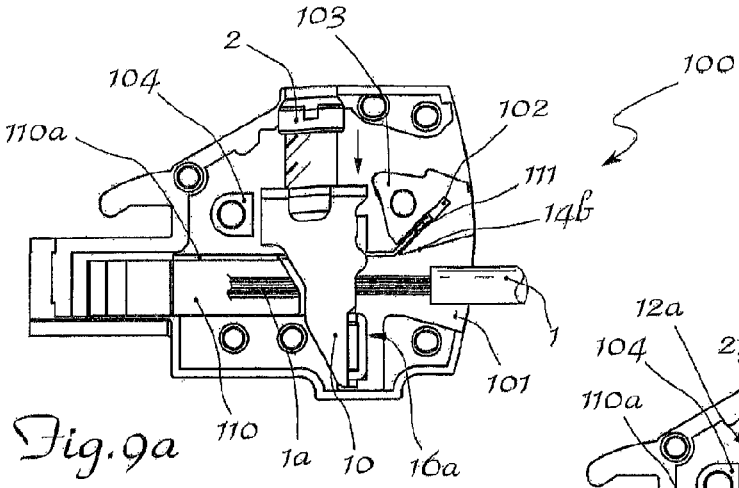
Figure 9B:
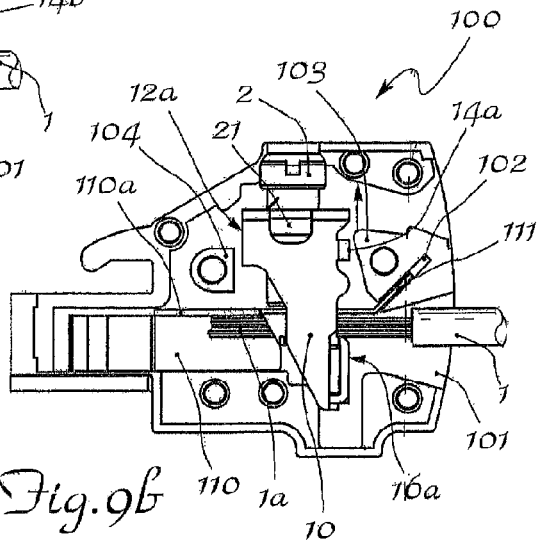
Figure 10:
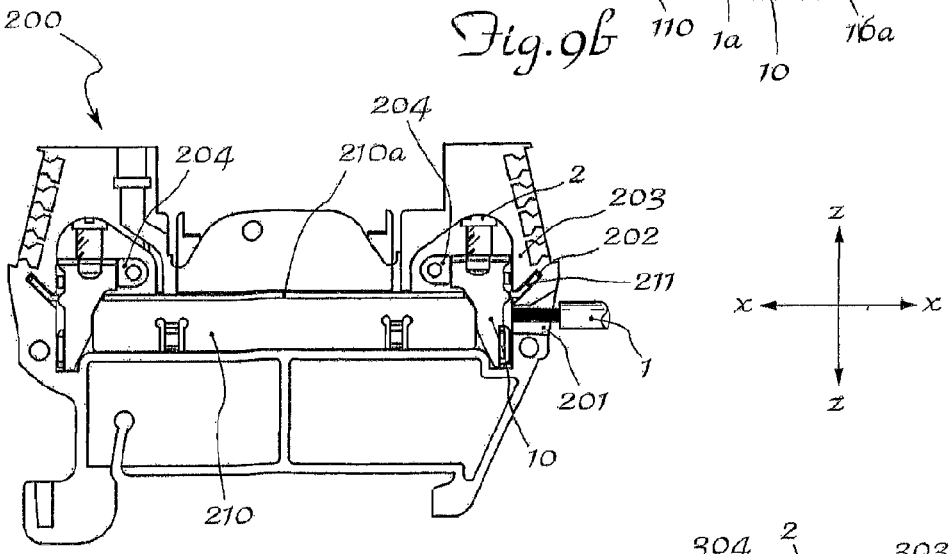
Figure 11:
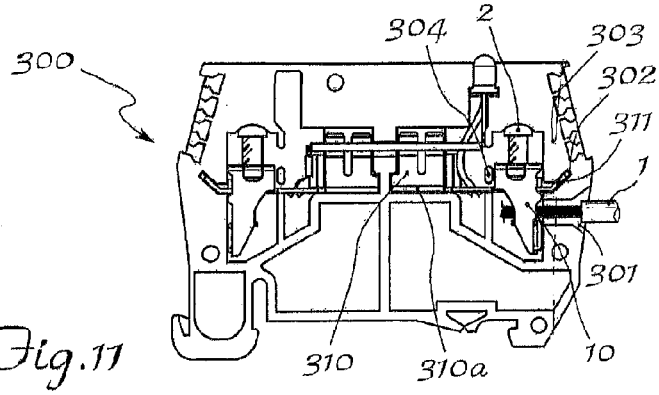

Further details may be obtained from the following description of a non-limiting example of embodiment of the subject of the present invention provided with reference to the accompanying drawings in which:

FIG. 1: shows a perspective view of the flat cut-out for forming a gripping element for electric wires according to the present invention;

FIG. 2: shows a perspective view, from the rear, of a gripping element for electric wires according to the present invention;

FIG. 3: shows a perspective view, from the front, of a gripping element for electric wires according to the present invention;

FIG. 4: shows a perspective view of the detail of the head of the gripping element;

FIG. 5: shows a top plan view of the gripping element;

FIG. 6: shows a view, from the rear, of the gripping element;

FIG. 7: shows a schematic cross-section along the plane indicated by the line VII-VII in FIG. 6;

FIG. 7*a*: shows a cross-section along a vertical plane of the gripping element with screw inserted;

FIG. 8: shows a perspective view, from below, of the detail of the base of the gripping element;

FIG. 9*a*,9*b*: shows a front view of a first example of a terminal block with gripping element according to the invention in the condition where the wire is inserted/gripped, respectively;

FIG. 10: shows a front view of a second example of a terminal block with gripping element according to the invention;

FIG. 11: shows a front view of a third example of a terminal block with gripping element according to the invention.

As shown and assuming solely for the sake of easier description and without any limitation of meaning a set of three reference axes in a longitudinal direction X-X, corresponding to the direction of insertion of an electric wire 1 through the gripping element, transverse direction Y-Y, perpendicular to the preceding direction, and vertical direction Z-Z, perpendicular to the head of the gripping element, as well as a rear side corresponding to the side for entry of the wire, and a front side, opposite to the preceding side, the gripping element according to the present invention comprises a conducting body substantially in the form of an overturned U with legs 10 extending in the vertical direction Z-X and head 20 connecting the top ends of the two legs 10.

In greater detail, the head 20 has a through-hole 21 with a female thread 21*a*, obtained by means of deep-drawing of a flat pressed part shown in FIG. 1 from which, by means of subsequent folding, the final form of the gripping element according to the invention is also obtained (FIGS. 2 and 3).

Conveniently the head 20 is cross-shaped with transverse arms 22 contained inside a respective eyelet 11 which is open in the top end of the opposite legs 10; with this configuration the hole 21 may be deep-drawn, making use of the thickness of the legs in order to maintain a suitable thickness of the annular part 21*b* of the hole itself which occupies partially the thickness of the leg 10 (FIG. 4) in the region of the eyelet 11, i.e. this allows also a sufficient amount of material of the head 20 to be maintained outside the hole 21 along the reduced transverse dimension. In addition to this and as shown in FIG. 7*a*, the actuating screw 2, extending beyond the hole 21 in the vertical direction Z-Z, brings its thread 2*a* into contact with the inner surfaces 10*b* of the legs 10, resulting in a relative friction due to the interference arising from the fact that the diameter of the screw is slightly greater than the internal distance between the legs 10; said relative friction effectively counteracts slackening of the screw.

The legs 10 of the gripping element have a front surface 10*a* cut along discontinuous lines so as to reduce the transverse dimension of the gripping element from the head towards the bottom ends, creating at the same time flat upper surfaces 12*a* adjacent to the head 20 and parallel to the vertical direction Z-Z.

At the rear of the gripping element each leg 10 has a first upper lug 14 folded in the transverse direction Y-Y so that the two lugs are situated opposite each other once formed.

Underneath the lugs 14 each leg 10 also has a rounded boss 15, the free end of which lies in the same plane as the free front end surface 23*a* of the top plane 23 of the cross-shaped head 20.

At the free end opposite to the head 20:

- one of the two legs 10 has a first lug 16 folded in an L shape with side 16*a* parallel to the vertical direction Z-Z and side 16*b* folded parallel to the longitudinal direction X-X; the vertical side 16*a* forms an element for interfering with insertion of the wire in the longitudinal direction X-X and the longitudinal side 16*b* forms the element for gripping the end 1*a* of the wire 1 against a fixed conductor body as described in detail further below;
- the other leg 10 has a second lug 17 folded parallel to the transverse direction Y-Y and arranged behind the first lug 16 in the longitudinal direction X-X.

Preferably both the first lug 16 and the second lug 17 have a respective bottom tooth 16*c*,17*c* folded in the opposite sense in the longitudinal direction X-X so as to interfere mutually in the transverse direction Y-Y, thus forming a stop element which opposes any undesirable opening of the legs 10 following the forces generated by gripping.

The rear surface of the vertical section 16*b* of the first lug 16 is in turn coplanar with the bosses 15 of the legs 10.

As will emerge more clearly below, the coplanar alignment of the free front end surface 23*a* of the front longitudinal arm 23 of the head 20, of the lugs 14, of the end of the bosses 15 and of the front end surface of the vertical section 16*b* of the first lug 16 forms the element for guiding the movement of the gripping element along the vertical direction Z-Z perpendicular to the longitudinal direction of insertion of the wire 1 (FIGS. 9*a*, 9*b*).

In addition to this (FIGS. 9*a*, 9*b*), the horizontal bottom surface 14*b* of the lugs 14 defines an end-of-travel stop against the conducting element 110,210,310 of the terminal block itself, ensuring suitable opening of the hole 101 for entry of the wire 1.

With these configurations and as shown in FIGS. 9 to 11, the gripping element according to the invention can be inserted in different types of electrical connection devices 100,200,300 all provided with:

- at least one hole 101,201,301 for inserting the wire 1 in the longitudinal direction X-X;
- an inclined seat 102,202,302, for receiving one end 111, 211,311 of a fixed conductor 110,210,310 which is inserted inside the terminal block and a longitudinal surface 110*a*,210*a*,310*a* of which forms the contact surface for gripping the wire 1*a;*
- a vertical hole for operating an actuating screw 2 of the gripping element;
- a rear raised element 103,203,303 and front raised element 104,204,304 for guiding the movement of the gripping element in the vertical direction Z-Z.

As shown in FIG. 9*a*, the electrical connection device is in the form of a connector 100 with engaging element 120; in the rest condition shown in the figure, the gripping element is lowered by operation of the screw 2 in the anti-clockwise direction; in this position the vertical part 16*a* of the first lug 16 is arranged underneath the entry hole 101 of the terminal block 100, in the vertical direction Z-Z, leaving the said hole free for insertion, in the longitudinal direction X-X, of the wire 1, the free end 1*a* of which penetrates through the gripping element being arranged on top of the longitudinal section 16*b* of the first lug 16; once the wire has been inserted, the screw 2 is operated by rotating it in the clockwise direction so that, by acting on the female thread 21*a* of the hole and remaining translationally fixed, it causes translation of the gripping element upwards in the vertical direction Z-Z; when the translational movement has ended (FIG. 9*a*), the wire 1*a* is gripped between the longitudinal lug 16*b* and the longitudinal surface 110*a* of the fixed conductor 110 and not by the contact with the screw which does not act on the wire.

During both the translational movements in the two senses of the vertical direction Z-Z, the gripping element is correctly guided and kept parallel to the vertical direction Z-Z itself by the interaction between the surfaces, which are coplanar with each other, i.e. front free surface 23*a* of the plane 23 of the head 20, free surface of the bosses 15 and front surface of the vertical section 16*a* of the first lug 16, with corresponding surfaces of the front raised element 103,203,303 of the terminal block 100,200,300; and by the interaction of the free surface 23*a* of the head 20 with the rear raised element 104, 204,304 of the terminal block 100,200,300 itself.

Operation is entirely similar also in the case of electrical connection devices which are in the form of a through terminal block 200 or isolating terminal block 300—shown in FIGS. 10 and 11, respectively—which are therefore not described in detail.

It is therefore clear how with the gripping element according to the present invention it is possible to achieve very simple and fast mass production with at the same time savings in the amount of material used and a reduction in the overall dimensions, while ensuring at the same time both a high current load, owing to the large contact surfaces between the lug 16*b*, the wire 1*a* and the fixed conducting element 110, 210,310, and easy screw operation, as well as a large entry opening for the wire which allows also the insertion of wires with a large cross-section without a reduction in the distributed clamping force.

In addition to this it can be seen how the female thread of the gripping element which cooperates with the actuating screw is formed in the thickness of a single face instead of a double face as in the prior art with a consequent reduction in material, but without weakening of the structure, owing to the particular cross-shaped form of the head of the overturned U.

Although described in connection with certain constructional forms and certain preferred examples of embodiment of the invention, it is understood that the scope of protection of the present patent is defined solely by the following claims.

What is claimed is:

1. A conductive gripping element for retaining electric wires (1,1*a*), comprising:

a body in the form of an overturned "U" with legs (10) extending in the vertical direction (Z-Z) and head (20) connecting in the transverse direction the top ends of the said legs (10), wherein the head (20) of the "U" is cross-shaped with longitudinal arms (23) and transverse arms (22) and has a hole (21) with a female thread (21*a*), suitable for engagement with an actuating screw (2,2*a*), and with a deep-drawn annular part (21*b*) partially comprised in the transverse direction (Y-Y) within the thickness of the legs (10) of the "U" opposite a respective eyelet (11) formed in the end of the leg (10) adjacent to said head (20).

2. The gripping element according to claim 1, wherein the thread (2*a*) of the tightening screw (2) interferes in the transverse direction with the inner surfaces (10*b*) of the legs (10).

3. The gripping element according to claim 1, wherein each leg (10) has a first rear lug (14) folded in the transverse direction (Y-Y) so that the two lugs (14) are situated opposite each other once formed.

4. The gripping element according to claim 1, wherein each leg (10) has a rear boss (15).

5. The gripping element according to claim 1, wherein one of the two legs (10) has a first lug (16) folded in an L shape with side (16*a*) parallel to the vertical direction (Z-Z) and side (16*b*) folded parallel to the longitudinal direction (X-X).

6. The gripping element according to claim 5, wherein the other leg (10) has a second lug (17) folded parallel to the transverse direction (Y-Y) and arranged in front of the first lug (16) in the longitudinal direction (X-X).

7. The gripping element according to claim 6, wherein the first lug (16) and the second lug (17) have a respective bottom tooth (16*c*,17*c*) folded in the opposite sense in the longitudinal direction (X-X).

8. The gripping element according to claim 1, wherein the free front end surface (23*a*) of the front longitudinal arm (23) of the head (20), the lugs (14), the bosses (15) and the front end surface of the vertical section (16*b*) of the first lug (16) are coplanar with each other.

9. The gripping element according to claim 1, wherein the transverse bottom surface (14*b*) of the lugs (14) is an end-of-travel stop.

10. An electrical connection device (100,200,300) comprising:

at least one hole (101,201,301) for inserting a wire (1) in the longitudinal direction (X-X);

an inclined seat (102,202,302) for receiving one end (111, 211,311) of a fixed conductor (110,210,310) which is inserted inside the terminal block and a longitudinal surface (110*a*,210*a*,310*a*) of which forms the contact surface for gripping the wire (1*a*);

a vertical hole for operating a translationally fixed actuating screw (2) of the gripping element;

a rear raised element (103,203,303) and front raised element (104,204,304) for guiding a gripping element in the vertical direction (Z-Z), wherein said gripping element comprises:

a body in the form of an overturned "U" with legs (10) extending in the vertical direction (Z-Z) and head (20) connecting in the transverse direction the top ends of the said legs (10), wherein the head (20) of the "U" is cross-shaped with longitudinal arms (23) and transverse arms (22) and has a hole (21) with a female thread (21*a*), suitable for engagement with an actuating screw (2,2*a*), and with a deep-drawn annular part (21*b*) partially comprised in the transverse direction (Y-Y) within the thickness of the legs (10) of the "U" opposite a respective eyelet (11) formed in the end of the leg (10) adjacent to said head (20).

11. The electrical connection device according to claim 10, wherein said gripping element is translationally movable in both senses of the vertical direction (Z-Z) upon rotational actuation of the translationally fixed screw.

12. The electrical connection device according to claim 10, wherein it is a connector (100).

13. The electrical connection device according to claim 10, wherein it is a terminal block (200; 300).

* * * * *